US005638922A

United States Patent [19]

Morikawa

[11] Patent Number: 5,638,922

[45] Date of Patent: Jun. 17, 1997

[54] PULL-BACK WINDUP TYPE SPRING DRIVE UNIT

[75] Inventor: Ryota Morikawa, Tokyo, Japan

[73] Assignee: Seikoken Kabushiki Kaisha, Tokyo, Japan

[21] Appl. No.: 530,056

[22] Filed: Sep. 19, 1995

[30] Foreign Application Priority Data

Sep. 21, 1994 [JP] Japan ..... 6-254435

[51] Int. Cl.[6] ..... A63H 29/00; F03G 1/06

[52] U.S. Cl. ..... 185/39; 185/DIG. 1; 446/464

[58] Field of Search ..... 185/39, DIG. 1; 446/457, 464

[56] References Cited

U.S. PATENT DOCUMENTS

| | | | |
|---|---|---|---|
| 4,463,831 | 8/1984 | Wakase | 185/39 |
| 4,478,313 | 10/1984 | Wakase | 185/139 |
| 4,568,308 | 2/1986 | Itoh | 446/464 |
| 4,710,147 | 12/1987 | Wakase | 446/464 |
| 4,786,269 | 11/1988 | Nagel et al. | 446/464 |
| 5,176,223 | 1/1993 | Ito | 185/139 |
| 5,188,198 | 2/1993 | Muramatsu et al. | 185/139 |
| 5,372,534 | 12/1994 | Levy et al. | 446/457 |

*Primary Examiner*—Charles A. Marmor
*Assistant Examiner*—Troy E. Grabow
*Attorney, Agent, or Firm*—Notaro & Michalos P.C.

[57] ABSTRACT

The present invention is a pull-back, windup type spring drive unit with two output shafts capable of transmitting driving force to the front-wheels and rear-wheels. This unit is provided with: a frame; front-wheel and rear wheel output shafts; a drive gear; a spring; a windup gear mechanism; first and second running gear mechanisms connectable to the front-wheel and rear-wheel shafts; and a constant speed mechanism. When one of the output shafts is rotated for winding, switching gear of the windup gear mechanism moves to a mesh position and the rotation of the output shaft for winding is transmitted to the drive gear to wind up the spring. When the drive gear is rotated for running, switching gears of the respective running gear mechanism move to the respective mesh positions to transmit the rotation of the drive gear to each of the output shafts.

7 Claims, 5 Drawing Sheets

PULL-BACK WINDUP TYPE SPRING DRIVE UNIT

BACKGROUND OF THE INVENTION

1. Field of the Invention

The present invention relates to a pull-back windup type spring drive unit used as a driving source for a toy car and others. More particularly, this invention relates to a pull-back windup type spring drive unit having two output shafts preferable for a four-wheel drive toy car.

2. Description of the Related Art

A conventional pull-back windup type spring drive unit is provided with one output shaft to which tires of a toy car are mounted at both ends thereof, and the output shaft is reversely rotated by pulling in the toy being put on a floor or the like, thereby winding up a spring. That is, the conventional pull-back windup type spring drive unit is configured in such a manner that the spring connected to a drive gear is wound up by transmitting rotation of the output shaft to the drive gear using a windup switching gear which meshes only at a time of rotation for winding and that rotation of the drive gear driven by the spring is transmitted to the output shaft by utilizing a running switching gear which meshes only at a time of rotation for running. In other words, this is a spring drive unit for two-wheel drive, which performs input and output of rotation by using a single output shaft.

Therefore, in the case where a four-wheel drive toy car is constituted by using the conventional spring drive unit, as shown in FIG. 5, the need for separately providing two units, i.e., a spring drive unit 103 for front-wheel drive and another spring drive unit 105 for rear-wheel drive involves an increase in a manufacturing cost of a toy 101. Further, since the two spring drive units 103 and 105 are aligned lengthwise when used, reduction in scale of the toy car 101 is difficult. In particular, if the units having the same winding-up and rotational directions are used, there must be additionally provided in the toy a space whose length corresponds to a length L from an output shaft 106 to an edge of the spring drive unit so as to protrude from a front wheel 102, and the scale of the toy is increased because of the thus-provided space, or the design of the toy may be restricted. Furthermore, as illustrated in FIG. 5, in the case where the spring drive units 103 and 105 are disposed in an opposed direction, it is required to prepare two units having different winding-up and rotational directions, thereby increasing the cost. Note that a reference numeral 104 denotes a rear wheel and 107 designates an output shaft on the rear wheel side in the drawing.

SUMMARY OF THE INVENTION

It is therefore an object of the present invention to provide a pull-back windup type spring drive unit which is capable of transmitting driving force to two output shafts and preferable for a four-wheel drive toy car.

To achieve this aim, a pull-back windup type spring drive unit according to the present invention comprises: a frame; first and second output shafts each of which is rotatably supported on the frame and has both ends protruding from the frame; a drive gear rotatably supported on the frame; a spring which is provided between the drive gear and the frame and rotates the drive gear for running; a first running gear mechanism which includes a first running switching gear which is put to engagement at the time of rotation of the drive gear for running and released from engagement at the time of rotation of the drive gear for winding, and transmits the rotation of the drive gear for running to the first output shaft; a second running gear mechanism which includes a second running switching gear which is put to engagement at the time of rotation of the drive gear for running and released from engagement at the time of rotation of the drive gear for winding, and transmits the rotation of the drive gear for running to the second output shaft; a constant speed mechanism which is connected to at least either the first running gear mechanism or the second running gear mechanism only at the time of rotation for running and restricts a free rotation of the connected running gear mechanism; and a windup gear mechanism that includes a windup switching gear which is engaged with the drive gear at the time of rotation of the first or second output shaft for winding and released from engagement at the time of rotation of the first or second output shaft for running, and transmits the rotation of the first output shaft for winding to the drive gear to wind up the spring only when the windup switching gear is put to engagement.

Therefore, the winding-up rotation of an output shaft, e.g., the first output shaft to which the windup gear mechanism is connected involves the movement of the windup switching gear of the windup gear mechanism to an engagement position, whereby the windup switching gear is engaged with the drive gear. The winding-up rotation of the first output shaft is then transmitted to the drive gear to wind up the spring.

On the other hand, when the drive gear is rotated for running by the wound-up spring, the respective running switching gears of the first and second running gear mechanisms move to the corresponding engagement positions to be engaged with the first and second output shafts. At the same time, the windup switching gear of the windup gear mechanism is released from engagement. The running rotation of the drive gear is then transmitted to each output shaft to be rotated at the same speed in the same direction. In this case, each running gear mechanism is connected to the drive gear, respectively, and the constant speed mechanism restricts the rotational speed for transmission of at least one of the respective running gear mechanism, whereby a desired rotational speed for running of each output shaft can be obtained, thus enabling the running rotation for a relatively-long time.

As described above, in the present invention, since two output shafts which rotate in the same direction are obtained from a single pull-back windup type spring drive unit, a four-wheel drive toy car can be configured by using one spring drive unit. The four-wheel drive toy car can be therefore constituted even if only one spring drive unit is used, and the manufacturing cost can be suppressed. Further, since use of one spring drive unit can do, the scale of the toy car can be reduced. Furthermore, by omitting one of the front- and rear-wheel-side running gear mechanisms and an output shaft corresponding therewith, the spring drive unit can be easily diverted to a two-wheel drive toy car and others, and there is hence an advantage that the generality of the spring drive unit can be improved.

DESCRIPTION OF A PREFERRED EMBODIMENT

The present invention will now be described in detail hereinbelow in connection with an illustrative embodiment.

Figure 1:
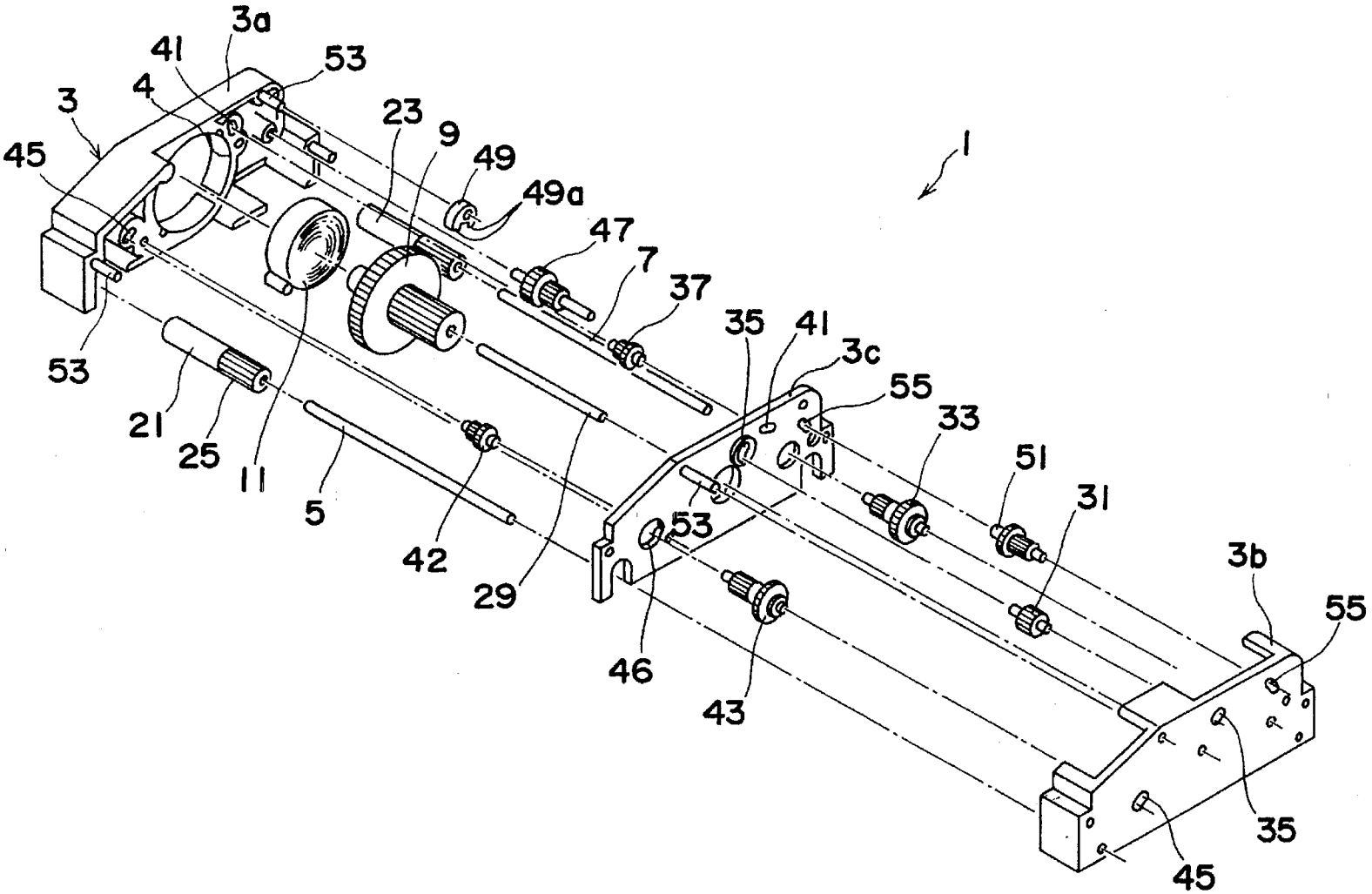
FIG. 1 is an exploded perspective view showing an embodiment of a pull-back windup type spring drive unit according to the present invention.
Figure 2A:
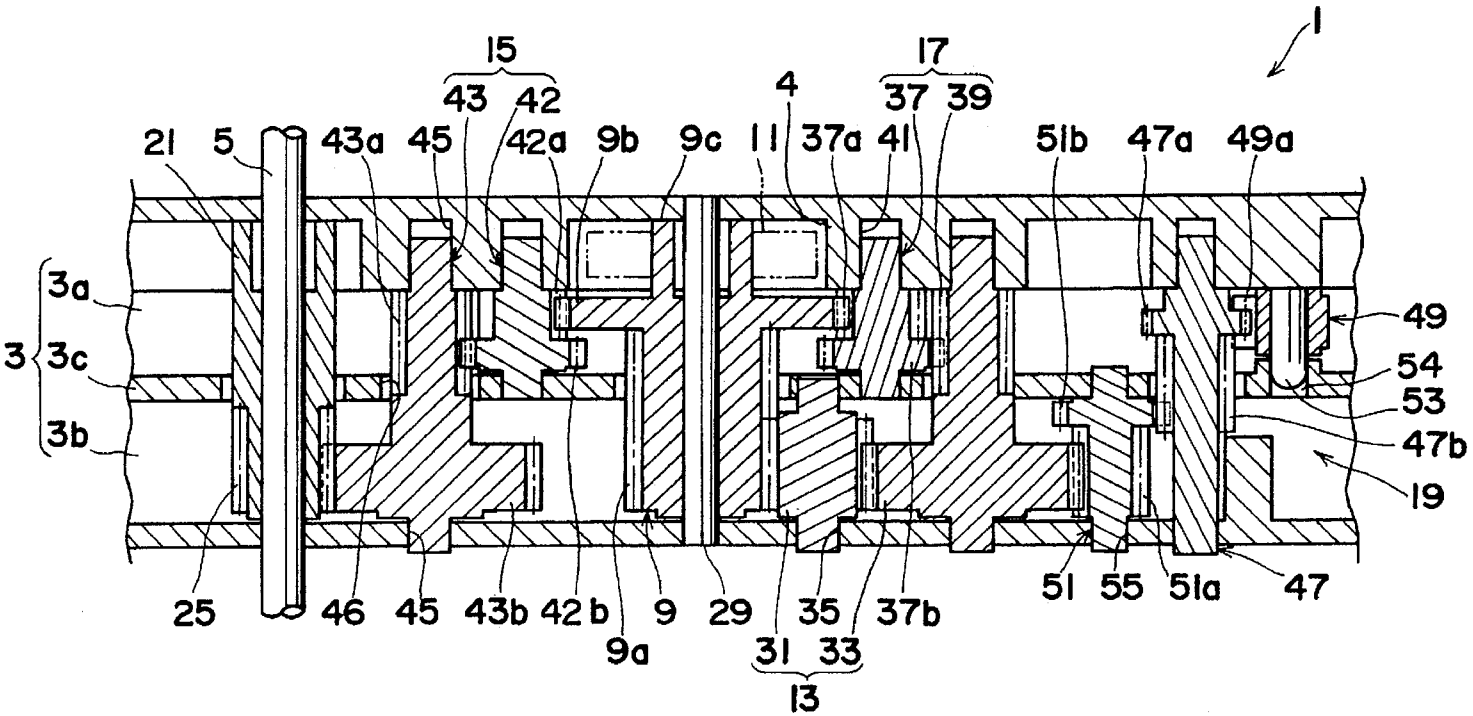
FIGS. 2A and 2B together are a development showing a relationship of arrangement of respective gears and others of the pull-back windup type spring drive unit illustrated in FIG. 1.
Figure 2B:
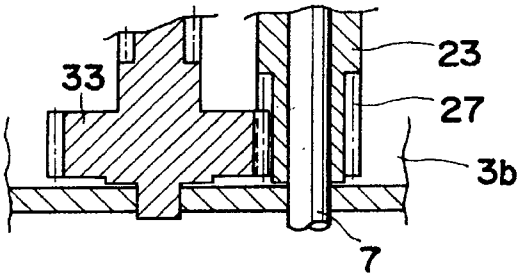

FIGS. 1 and 2A and 2B show an embodiment of a pull-back windup type spring drive unit to which the present invention is applied. The pull-back windup type spring drive unit (simply referred to as a spring drive unit hereinbelow) 1 is mainly made up of: a frame 3; first and second output shafts 7 and 5 on rear- and front-wheel sides; a drive gear 9; a spring 11; a windup gear mechanism 13 for transmitting to the drive gear 9 the winding-up rotation conducted from one of the output shafts (in case of the present embodiment, the first output shaft 7 on the rear-wheel side); a second running gear mechanism 15 for transmitting the rotation of the drive gear 9 to the second output shaft 5; a first running gear mechanism 17 for transmitting the rotation of the drive gear 9 to the first output shaft 7; and a constant speed mechanism 19 for controlling the free rotation of the rotation for running. Incidentally, the frame 3, each gear and others in the spring drive unit may preferably be injection-molded with, e.g., plastic and, in such a case, easiness of manufacturing and the manufacturing cost can be enhanced. It is understood that they may be manufactured with metal depending on the situation.

The frame 3 is constituted by a right-side part 3*a*, a left-side part 3*b* and a central wall 3*c* provided therebetween, and rotatably supports each gear and the output shafts 5 and 7. The frame 3 is integrally assembled by inserting a plurality of pins 53 formed to the right-side part 3*a* and the central wall 3*c* at predetermined positions into a plurality of holes 54 bored in the left-side part 3*b* at positions corresponding with the pins 53. Further, as later described in detail, respective elongated holes 35, 41, 45 and 55 or the pins 53 are provided at predetermined positions of the respective parts 3*a* and 3*b* and the central wall 3*c*.

The front-wheel-side output shaft 5 which is the second output shaft is arranged beneath and in the vicinity of a front edge (the left-side end in the drawing) of the frame 3, while the rear-wheel-side output shaft 7 which is the first output shaft is provided beneath and in the vicinity of a rear edge of the frame 3, respectively, and they are extended in the width-wise direction of the car. Both ends of each output shaft 5 or 7 protrude toward outside of the frame 3. Further, sleeves 21 and 23 are pushed to be put on the output shafts 5 and 7 at the central portions thereof, thereby being fixed. The respective sleeves 21 and 23 are pierced through the central wall 3*c* of the frame 3 and so provided as to extend between the right-side part 3*a* and the left-side part 3*b*. Gears 25 and 27 are molded integrally with the sleeves 21 and 23 at portions within the left-side part 3*b*, respectively. Each pinion gear 25 or 27, therefore, integrally rotates with each output shaft 5 or 7.

The drive gear 9 is pierced through the central wall 3*c* and so arranged as to extend between the right-side part 3*a* and the left-side part 3*b* in the central portion within the frame 3. The drive gear 9 is rotatably supported by a shaft 29. The drive gear 9 is composed of a small-diameter gear 9*a* and a large-diameter gear 9*b*, and these gears are integrally molded. The small-diameter gear 9*a* is arranged within the left-side part 3*b* and the large-diameter gear 9*b* is provided within the right-side part 3*a*. Moreover, a bifurcate arm 9*c* is provided on a surface opposed to the other surface on which the small-diameter gear 9*a* of the drive gear 9 is disposed, and an inside end portion of the spring 11 is wound around the arm 9*c*.

The spring 11 is enclosed in a cylindrical housing 4 inwardly protruding from the right-side frame 3 of the drive gear 9 and placed between the drive gear 9 and the frame 3. An outer end of the spring 11 is fitted and caught in a groove (not shown) provided on the inner peripheral wall surface of the cylindrical housing 4 in the frame 3, so that the spring 11 move over the groove when a given force acts thereon. That is, one end of the spring 11 is caught in the frame 3 while the other end of the same is engaged with an arm 9*c* of the drive gear 9. Therefore, in the case where the drive gear 9 rotates in the winding direction (or rotates for winding) indicated by an arrow head CCW in FIG. 3, the spring 11 is wound up. On the other hand, the drive gear 9 is driven to rotate in the running direction (or rotate for running) indicated by an arrow head CW in FIG. 4 if the elastic force of the wound spring 11 is displayed. Further, before the spring 11 is excessively wound up, namely, when the spring 11 is affected by a force having value exceeding a predetermined value, the spring 11 comes off the groove of the housing 4 to avoid the damage due to the excessive winding of the spring 11.

The windup gear mechanism 13 is made up of the drive gear 9, the pinion gear 27 on the first output shaft 7, a large-diameter gear 33 and a switching gear 31, and disposed within the left-side part 3*b* of the frame 3. The large-diameter gear 33 is molded integrally with a small-diameter gear 39 and rotatably supported on the frame 3. The large-diameter gear 33 constantly meshes with the above-mentioned pinion gear 27.

The windup switching gear 31 has a shaft portion engaged with two elongated holes 35 bored in the central wall 3*c* and the left-side part 3*b*, and is so supported as to be capable of moving around the large-diameter gear 33 while meshing therewith at the shaft portion. While the windup switching gear 31 constantly meshes with the large-diameter gear 33, it also meshes with the small-diameter gear 9*a* of the drive gear 9 only at the time of rotation for winding. Further, the windup switching gear 31 is provided in such a manner that it comes off the small-diameter gear 9*a* of the drive gear 9 during rotation for running.

Each elongated hole 35 bends and extends in the same concentric circular form with that of the large-diameter gear 33. Thus, when the large-diameter gear 33 rotates for winding (which is the rotation in a direction indicated by the arrow head CCW in FIG. 3), the switching gear 31 is pushed by this rotational force in the direction CCW to move in each elongated hole 35 and meshes with the small-diameter gear 9*a* of the drive gear 9. Meanwhile, at the time of rotation for running, the windup switching gear 31 is thrusted in the direction CW by the rotation for running (i.e., the rotation in the direction indicated by the arrow head CW in FIG. 4) of the small-diameter gear 9*a* of the drive gear 9 and the large-diameter gear 33 to move to the right-side end position in each elongated hole 35 as shown in the drawing, and is then distanced apart from the small-diameter gear 9*a*. This windup gear mechanism 13 usually constitute a reduction gear mechanism for decelerating and transmitting the rotation of the output shaft.

The first running gear mechanism 17 on the rear-wheel side includes a first running switching gear 37, a small-diameter gear 39 and the pinion gear 27 of the first output shaft 7, and is provided within the right-side part 3*a*. The small-diameter gear 39 is integrally molded with the above-described large-diameter gear 33 and rotatably supported on the frame 3.

The first running switching gear 37 is composed of a small-diameter gear 37*a* and a large-diameter gear 37*b* disposed on one side of the small-diameter gear 37*a*, and integrally molded with these gears. The first running switching gear 37 has a shaft portion fitted in two elongated holes 41 bored in the right-side part 3*a* and the central wall 3*c* of the frame 3 and is movably supported, and the small-diameter gear 37*a* constantly meshes with the large-diameter gear 9*b* of the drive gear 9. On the other hand, the large-diameter gear 37*b* meshes with the small-diameter gear 39 only at the time of rotation for running and is so formed as to come off the small-diameter gear 39 during rotation for winding.

Figure 3:
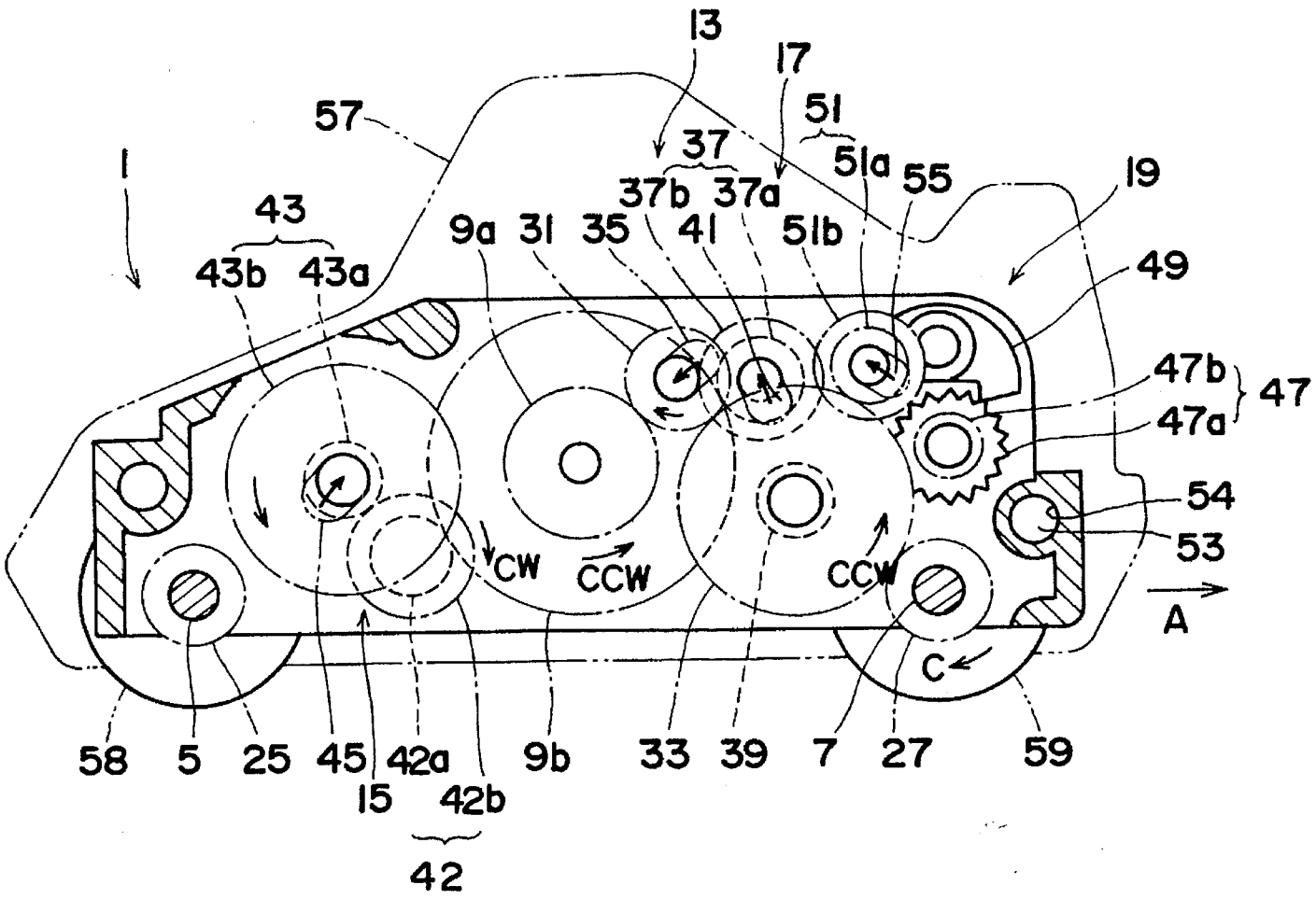
FIG. 3 is a side view showing a state of winding-up rotation, wherein an operation of the pull-back windup type spring drive unit of FIG. 1 is illustrated.
Figure 4:
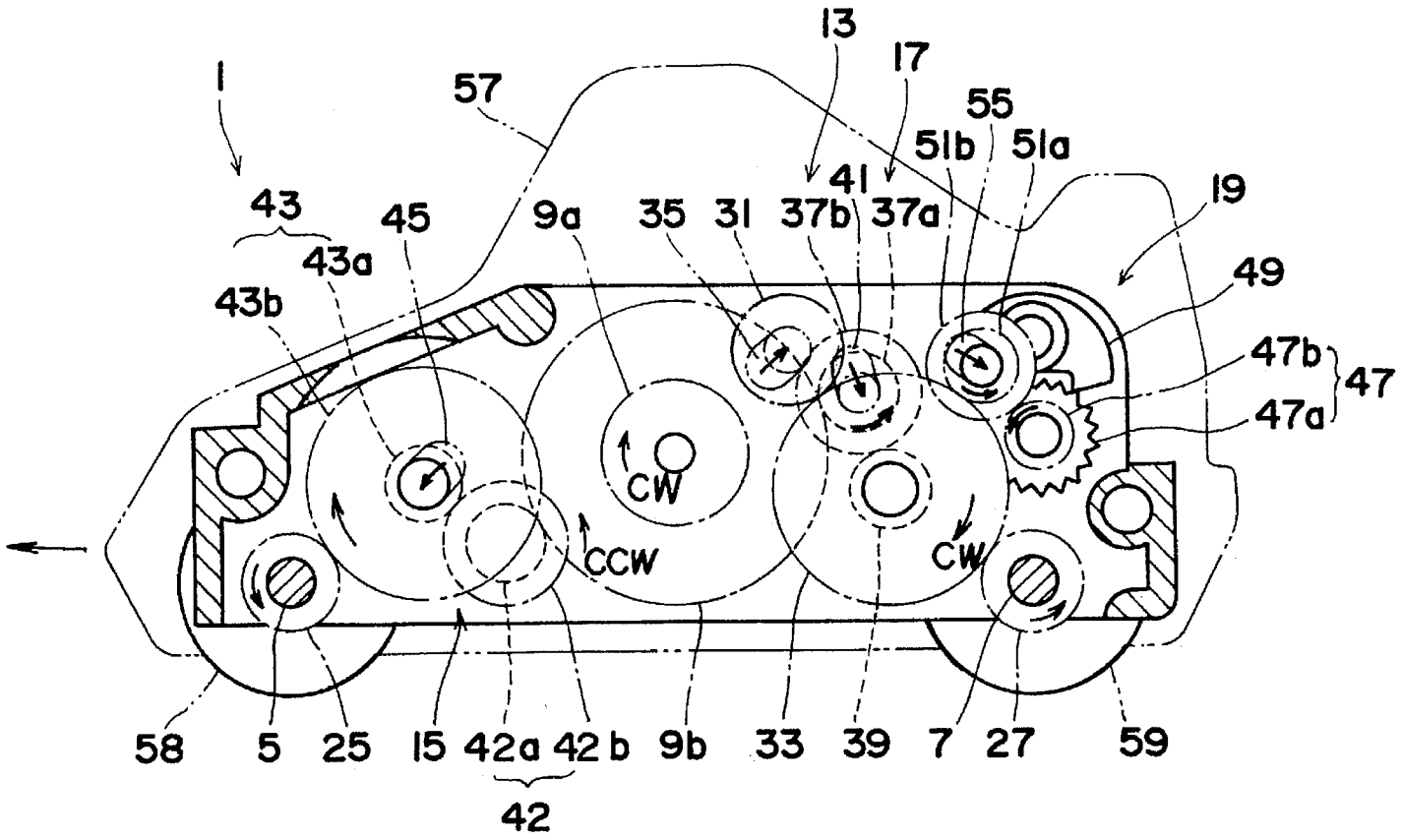
FIG. 4 is a side view showing a state of running rotation, wherein an operation of the pull-back windup type spring drive unit of FIG. 1 is illustrated.
Figure 5:
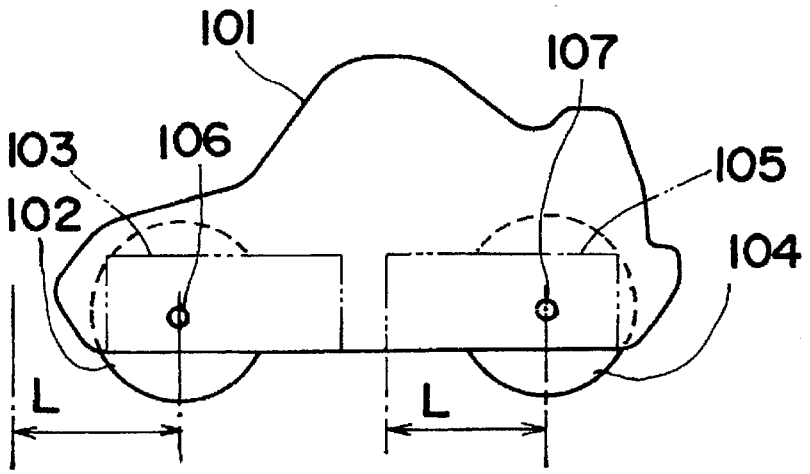
Fig. 5 (PRIOR ART)
FIG. 5 is a conceptual view showing a four-wheel drive toy car in which a conventional pull-back windup type spring drive unit is used.

Each elongated hole 41 bends and extends in the same concentric circular form with that of the large-diameter gear 9*b*. As shown in FIG. 4, the first running switching gear 37 is thus pushed in the direction CW by the rotation of the large-diameter gear 9*b* of the drive gear 9 and moves in each elongated hole 41 to mesh with the small-diameter gear 39 during rotation for running. On the other hand, as shown in FIG. 3, the first running switching gear 37 is pushed up in the direction CCW within each elongated hole 41 by the rotation of the small-diameter gear 39 in the direction CCW and spaced apart from the small-diameter gear 39 at the time of rotation for winding. Also, this detached state is maintained by the rotation of the large-diameter gear 9*b* in the direction CCW. The first running gear mechanism 17 on the rear-wheel side is usually constituted is an accelerating rotary gear train.

The second running gear mechanism 15 on the front-wheel side is composed of the large-diameter gear 9*b* of the drive gear 9, an idle gear 42 (also referred to as a second drive gear), a second running switching gear 43 and the pinion gear 25 on the front-wheel-side second output shaft 5. The idle gear 42 is made up of a small-diameter gear 42*a* and a large-diameter gear 42*b* and integrally molded with these gears. The small-diameter gear 42*a* constantly meshes with the large-diameter gear 9*b* of the drive gear 9. Further, the second running switching gear 43 is constituted by a small-diameter gear 43*a* and a large-diameter gear 43*b* provided on one side of the small-diameter gear 43*a*, and integrally molded with these gears. The second running switching gear 43 has a shaft portion fitted in respective elongated holes 45 bored in the parts 3*a* and 3*b* and the central wall 3*c* of the frame 3 so as to be movably supported, and the small-diameter gear 43*a* always meshes with the large-diameter gear 42*b* of the idle gear 42 while the large-diameter gear 43*b* meshes with the gear 25 only at the time of rotation for running.

Each elongated hole 45 bends and extends in the same concentric circular form with that of the idle gear 42. Thus, when the large-diameter gear 42*b* of the idle gear 42 is rotated for running (i.e., rotation in a direction indicated by the arrow head CCW in FIG. 4), this rotation involves the movement of the second running switching gear 43 in the direction CCW within each elongated hole 45, and the large-diameter gear 43*b* meshes with the pinion gear 25 on the second output shaft 5. On the other hand, the second running switching gear 43 is pushed up in the direction CW and detached from the pinion gear 25 by the rotation of the pinion gear 25 which is integral with the second output shaft 5 in the direction CW, and the rotation of the large-diameter gear 42*b* in the direction CW gives an impetus to move the switching gear 43 toward the upper edge of the elongated hole 45. The front-wheel-side first running gear mechanism 15 usually constitutes an accelerating gear train and is set to have the same gear ratio with that of the rear-wheel-side first running gear mechanism 17.

The constant speed mechanism 19 is made up of an escape wheel 47, an anchor member 49 and a constant speed switching gear 51 which rotates while meshing with the large-diameter gear 33 when the large-diameter gear 33 rotates for running. The escape wheel 47 is formed of a star gear 47*a* and a pinion 47*b* provided on one side of the star gear 47*a*, and integrally molded with these members. The escape wheel 47 is disposed above the rear-wheel-side first output shaft 7 in the frame 3 and rotatably supported on the frame 3.

The anchor member 49 is provided above and engaged with the escape wheel 47. The anchor member 49 is so supported as to be capable of oscillation by utilizing pins 53 for integrating the respective parts 3*a*, 3*b* and 3*c* of the frame 3. The anchor member 49 oscillates as the escape wheel 47 rotates, and is so provided as to make the rotation of the escape wheel 47 intermittent by alternately bringing the respective edges 49*a* into contact with the star gear 47*a* and control the free running such that the spring is instantaneously released for enabling the rotation at a substantially-constant speed.

The constant speed switching gear 51 includes a small-diameter gear 51*a* and a large-diameter gear 51*b* and integrally molded with these gears. The switching gear 51 has a shaft portion fitted in two elongated holes 55 bored in the left-side part 3*b* and the central wall 3*c* of the frame 3 so as to be rotatably supported; the small-diameter gear 51*a* thereof constantly meshes with the large-diameter gear 33 constituting the first running gear mechanism 17; and the large-diameter gear 51*b* thereof meshes with the pinion 47*b* of the escape wheel 47 only at the time of rotation for running and is detached from the pinion 47*b* during the rotation for winding.

Each elongated hole 55 bends and extends in the same concentric circular form with that of the large-diameter gear 33. Further, each elongated hole 55 is formed at a position where the constant speed switching gear 51 falls due to the dead load and meshes with the pinion 47*b* of the escape wheel 47. Therefore, as shown in FIG. 4, in the case where the large-diameter gear 33 rotates for running, this rotation gives an impetus to move the constant speed switching gear 51 in a direction for meshing with the pinion 47*b*, namely, the direction CW, within each elongated hole 55. At the same time, the constant speed switching gear 51 is also given an impetus to be moved toward the pinion 47*b* by the dead load thereof. The large-diameter gear 51*b* thus meshes with the pinion 47*b* simultaneously with a change to the rotation for running. Also, the rotation for free running is controlled. Meanwhile, as shown in FIG. 3, in the case where the large-diameter gear 33 is rotated for winding, this rotation gives an impetus to move the switching gear 51 to the direction CCW in the respective elongated holes 55 and the switching gear 51 is detached from the pinon 47*b*.

The operation of the spring drive unit 1 will now be described with reference to FIGS. 3 and 4.

The spring drive unit 1 is set in, for example, a frame 57 or the like of a toy car and tires 58 and 59 having the same diameter are mounted at both ends of the respective output shafts 5 and 7 in order to constitute the toy car.

In case of winding the spring 11 of the spring drive unit 1, as shown in FIG. 3, the toy car is moved backward (i.e., a direction indicated by an arrow head A in the drawing) while pushing the toy car on a non-illustrated floor or the like, and the rear-side tire 59 of the toy car is rotated in a direction indicated by an arrow head CW in the drawing.

The rotation of the rear-wheel-side output shaft 7 and the gear 27 for winding is transmitted in the order of the gear 39, the gear 33, the gear 31 and the gear 9*a* to wind up the spring 11. Simultaneously, the front-wheel-side output shaft 5 also rotates but its rotation is not transmitted beyond the pinion 25. The rotation of the gear 27 is thus transmitted to the drive gear 9 while reducing the rotational speed thereof, and the spring 11 is efficiently wound up with a large rotating torque.

Note that the first and second running gear mechanisms 17 and 15 and the respective switching gears 37, 43 and 51 of the constant speed mechanism 19 are moved to each position shown in FIG. 3 with the rotation for winding and are detached from the small-diameter gear 39, the gear 25 and the escape wheel 47. When the spring 11 is wound up, therefore, the first and second running gear mechanisms 17 and 15 do not operate and the constant speed mechanism 19 is also inactivated, thereby preventing the damage of the gears and others from being generated.

After the spring 11 is wound up, when a hand is taken off from the toy car, the spring is released to rotate the drive gear 9 and, as shown in FIG. 4, this rotation is transmitted to the first and second output shafts 7 and 5.

In regard of the rear-wheel-side first running gear mechanism 17, the rotation of the drive gear 9 for running causes the large-diameter gear 37*b* of the first running switching gear 37 to be shifted to a position illustrated in FIG. 4 and to mesh with the small-diameter gear 39. Thus, the rotation of the drive gear 9 for running is transmitted to the gear 27 while increasing the speed through the first running switching gear 37, the small-diameter gear 39 and the large-diameter gear 33 to rotate the rear-wheel-side output shaft 7.

At this time, the constant speed switching gear 51 of the constant speed mechanism 19 is moved to a mesh position illustrated in FIG. 4 by the rotation of the large-diameter gear 33 for running. The pinion 47*b* of the escape wheel 47 thus meshes with the large-diameter gear 51*b* of the constant speed switching gear 51 to rotate the star gear 47*a*. Since the rotational speed of the star gear 47*a* is restricted by the anchor member 49, the star gear 47, or the large-diameter gear 33 and the gear 27 rotate for running at a relatively-low speed for a comparatively-long time.

Further, since the direction in which the constant speed switching gear 51 moves is equal to the direction in which the large-diameter gear 33 rotates and the direction of drop caused due to the gravitation, the switching gear 51 rapidly moves as the large-diameter gear 33 starts its rotation, and the constant speed mechanism 19 starts to operate at substantially the same time with the beginning of the rotation of the drive gear 9 for running.

Simultaneously, the rotation of the drive gear 9 for running is also transmitted to the front-wheel-side second output shaft 5 through the front-wheel-side second running gear mechanism 15. In other words, the rotation of the drive gear 9 for running involves the rotation of the idle gear 42 in the direction indicated by the arrow head CCW in FIG. 4 and the second running switching gear 43 is moved to the position illustrated in FIG. 4 so that the large-diameter gear 43*b* meshes with the gear 25. The rotation of the drive gear 9 for running is, therefore, transmitted to the front-wheel-side output shaft 5 through the idle gear 42, the second running switching gear 43 and the gear 25. In this case, the second running gear mechanism 15 on the front-wheel side is also connected to the rear-wheel-side first running gear mechanism 17 through the drive gear 9 and these mechanisms have the same gear ratio, and hence they integrally rotate. Accordingly, the speed of the rotation for running which is transmitted by the front-wheel-side running gear mechanism 15 is restricted by the constant speed mechanism 19, and the respective output shafts 5 and 7 rotate at the same rotating speed for the same interval of time.

Incidentally, when the drive gear 9 rotates for running, the switching gear 31 of the windup gear mechanism 13 is moved away from its mesh position by the rotational force of the large-diameter gear 33 and spaced apart from the drive gear 9. At the time of the rotation of the drive gear 9 for running, the windup gear mechanism 13, therefore, does not operate.

As mentioned above, since the rotation of the drive gear 9, which is driven by the spring 11, for running is transmitted to the respective output shafts 7 and 5 through the first and second running gear mechanisms 17 and 15, each of the tires 59 and 58 shows the driving force, respectively, and the toy car can be a four-wheel drive car by using one spring drive unit 1.

Although the above embodiment is a preferred example for embodying the present invention, the present invention is not restricted to this example and various modifications and other embodiments of the present invention are possible as long as they fall within the scope of the present invention. For example, although the constant speed mechanism 19 has been constituted by providing the escape wheel 47 and the anchor member 49 in the spring drive unit 1, the constant speed mechanism 19 is not limited to this structure. Namely, the structure is not restricted to a certain type if only the free rotation of the running gear mechanism can be controlled, and it is needless to say that it is possible to employ a governor mechanism utilizing a rotational resistance of a blade used in, e.g., a music box or another constant speed mechanism constituted by a circumferential wall and a damper consisting of rubber which is accommodated in the circumferential wail and extends by the centrifugal force at the time of rotation to be slid along the circumferential wall.

Further, the gear ratios of the first and second running gear mechanisms 15 and 17 have been set to the same value in the spring drive unit 1 of the present invention, but the present invention is not limited to this setting, and these gear mechanisms may have different gear ratios. In such a case, tires having different diameters may preferably be mounted to the front-wheel- and rear-wheel-side output shafts 5 and 7 so that the running speeds of four tires can be coincident to each other. Furthermore, although the present invention has been described the embodiment in which the constant speed mechanism 19 is incorporated in the first running rotation gear mechanism 17 on the rear-wheel side, the present invention is not restricted to this structure, and the constant speed mechanism 19 may be assembled into the second running rotation gear mechanism 15 on the front-wheel side.

Moreover, the spring drive unit 1 according to the present embodiment does not necessarily have to be used in the four-wheel drive toy car, and it may be used in a two-wheel drive toy car. In this case, the spring drive unit 1 can be preferable for the two-wheel drive toy car by omitting, for example, the front-wheel-side running gear mechanism 15, the front-wheel-side output shaft 5 corresponding therewith and others.

What is claimed is:

1. A pull-back windup type spring drive unit comprising: a frame; first and second output shafts each of which is rotatably supported on the frame and each with ends outwardly protruding from the frame; drive gear means rotatably supported on the frame for driving the first and second output shafts, the drive gear means comprising a first drive gear and a second drive gear; a spring connected between the drive gear means and the frame for rotating the drive gear means in a running direction; a first running gear mechanism, including a first running switching gear movable around the first drive gear in the running direction and to an engagement position when the drive gear means rotates in the running direction, the first running switching gear being movable around the first drive gear in an opposite winding direction which is opposite to the running direction, to a released position when the drive gear means rotates in the opposite winding direction, the first running switching gear transmitting running direction rotation of the drive gear means to the first output shaft to rotate the first output shaft in a forward direction with rotation of the drive gear means in the running direction; support means for supporting on the frame a second running gear mechanism that has a second running switching gear movable around the second drive gear to an engagement position when the drive gear means rotates in the running direction and to a released position when the drive gear means rotates in the winding direction, the second running switching gear transmitting running direction rotation of the drive gear means to the second output shaft to rotate the second output shaft in the forward direction, the support means including means for supporting the second running switching gear for movement around the second drive gear between the engagement and released positions for the second running switching gear; a constant speed mechanism connected to the first running gear mechanism only when the drive gear means rotates in the running direction, to restrict a free rotation of the first running gear mechanism only when the drive gear means rotates in the running directed, and to be disconnected from the first running gear mechanism when the drive gear means rotates in the winding direction so that the constant speed mechanism does not restrict rotation of the drive gear means in the winding direction; and a windup gear mechanism, including a windup switching gear mounted to be meshed with the drive gear means only at a time when the first output shaft rotates in an opposite rearward direction relative to the forward direction, for rotating the drive gear means in the winding direction for winding the spring, the windup switching gear being movable to a released position out of engagement with the drive gear means at a time when the drive gear means rotates in the running direction, for transmitting the rearward direction rotation of the first output shaft for winding to the drive gear means to wind the spring only when the windup switching gear is engaged with the drive gear means.

2. A pull-back windup type spring drive unit accordingly to claim 1, including a second running gear mechanism with a second running switching gear supported in the support means for supporting the second running gear mechanism, at least one wheel connected to each of the first and second output shafts for rotation in the forward and rearward directions, a diameter of the wheels and a gear ratio of the drive gear and the first and second running gear mechanisms being selected so that running speeds of the wheels are equal for the first and second output shafts.

3. A pull-back windup type spring drive unit comprising: a frame; first and second output shafts each of which is rotatably supported on the frame and each with ends outwardly protruding from the frame; a drive gear rotatably supported on the frame; a spring connected between the drive gear and the frame for rotating the drive gear in a running direction; a first running gear mechanism, including a first running switching gear movable to an engagement position when the drive gear rotates in the running direction, and to a released position when the drive gear rotates in an opposite winding direction, the first running switching gear transmitting running direction rotation of the drive gear to the first output shaft to rotate the first output shaft in a forward direction with rotation of the drive gear in the running direction; a second running gear mechanism including a second running switching gear movable to an engagement position when the drive gear rotates in the running direction and to a released position when the drive gear rotates in the winding direction, the second running switching gear transmitting running direction rotation of the drive gear to the second output shaft to rotate the second output shaft in the forward direction; a constant speed mechanism engaged with at least one of the first and second running gear mechanisms only when the drive gear rotates in the running direction to restrict a free rotation of the at least one of the first and second running gear mechanism which is engaged with the constant speed mechanism; and a windup gear mechanism, including a windup switching gear meshed with the drive gear when the first output shaft rotates in an opposite rearward direction relative to the forward direction, for rotating the drive gear in the winding direction for winding the spring, the windup switching gear being movable to a released position out of engagement with the drive gear at a time when the drive gear rotates in the running direction, for transmitting the rearward direction rotation of the first output shaft for winding to the drive gear to wind the spring only when the windup switching gear is engaged with the drive gear; said frame including an elongated hole for rotatably receiving said windup switching gear, said windup switching gear being movable to one end of said elongated hole for meshing with said drive gear, and to an opposite end of said elongated hole for being released from meshing with said drive gear.

4. A pull-back windup type spring drive unit according to claim 3, including a second running gear with second running switching gear mounted in the means for supporting the second running gear, the frame including further elongated holes for rotatably receiving each of the first and second running switching gears.

5. A pull-back windup type spring gear unit according to claim 4 including a constant speed switching gear mounted for movement between an engagement position for engaging the constant speed mechanism to the first running gear mechanism when the drive gear rotates in the running direction, and a released position disengaging the constant speed mechanism from the first running gear mechanism.

6. A pull-back windup type spring drive unit according to claim 5, including an idle gear rotatably mounted to the frame and engaged between the drive gear and the second running switch gear for moving the second running switch gear into its engagement position with rotation of the drive gear in the running direction.

7. A pull-back windup type spring drive unit comprising: a frame; first and second output shafts each of which is rotatably supported on the frame and each with ends outwardly protruding from the frame; a drive gear rotatably supported on the free; a spring connected between the drive gear and the frame for rotating the drive gear in a running direction; a first running gear mechanism, including a first running switching gear movable to an engagement position when the drive gear rotates in the running direction, and to a released position when the drive gear rotates in an opposite winding direction, the first running switching gear transmitting running direction rotation of the drive gear to the first output shaft to rotate the first output shaft in a forward direction with rotation of the drive gear in the running direction; a second running gear mechanism including a second running switching gear movable to an engagement position when the drive gear rotates in the running direction and to a released position when the drive gear rotates in the winding direction, the second running switching gear transmitting running direction rotation of the drive gear to the second output shaft to rotate the second output shaft in the forward direction; a constant speed mechanism engaged with at least one of the first and second running gear mechanisms only when the drive gear rotates in the running direction to restrict a free rotation of the at least one of the first and second running gear mechanism which is engaged with the constant speed mechanism; and a windup gear mechanism, including a windup switching gear meshed with the drive gear when the first output shaft rotates in an opposite rearward direction relative to the forward direction, for rotating the drive gear in the winding direction for winding the spring, the windup switching gear being movable to a released position out of engagement with the drive gear at a time when the drive gear rotates in the running direction, for transmitting the rearward direction rotation of the first output shaft for winding to the drive gear to wind the spring only when the windup switching gear is engaged with the drive gear; the frame including respective elongated holes for rotatably receiving each of the first and second running switching gears, each of the first and second running switching gears being movable from one end of its respective elongated hole to an opposite end of its respective elongated hole for movement between said engagement and released positions.

* * * * *